US007115809B2

(12) United States Patent
Kavanaugh

(10) Patent No.: US 7,115,809 B2
(45) Date of Patent: Oct. 3, 2006

(54) BANJO PICK-UP SYSTEM

(76) Inventor: John Kavanaugh, 985 E. Belmont Ave., Salt Lake City, UT (US) 84105

( * ) Notice: Subject to any disclaimer, the term of this patent is extended or adjusted under 35 U.S.C. 154(b) by 147 days.

(21) Appl. No.: 10/728,719

(22) Filed: Dec. 5, 2003

(65) Prior Publication Data

US 2005/0028669 A1 Feb. 10, 2005

Related U.S. Application Data

(60) Provisional application No. 60/431,442, filed on Dec. 6, 2002.

(51) Int. Cl.
*G10H 3/14* (2006.01)

(52) U.S. Cl. ..... 84/726; 84/269

(58) Field of Classification Search ..... 84/291, 84/269–272, 723–732, 735, 743
See application file for complete search history.

(56) References Cited

U.S. PATENT DOCUMENTS 555,636 A * 3/1896 Carter ..... 84/271
1,364,466 A * 1/1921 Eps ..... 84/270
1,424,296 A * 8/1922 Gardie ..... 84/270
3,780,202 A 12/1973 Law
4,213,368 A * 7/1980 Cox ..... 84/269
4,501,186 A * 2/1985 Ikuma ..... 84/726
4,602,547 A * 7/1986 Nyack et al. ..... 84/726
5,052,269 A * 10/1991 Young, Jr. ..... 84/728

* cited by examiner

*Primary Examiner*—Lincoln Donovan
*Assistant Examiner*—David S. Warren
(74) *Attorney, Agent, or Firm*—Bateman IP Law Group

(57) ABSTRACT

A banjo having an improved pick-up system includes at least one pick-up mounted on or near the banjo head. In one embodiment, a plurality of holes are formed in the banjo head so that metallic heads of a pick-up system can extend therethrough while causing minimal distortion to the innate sound produced by the banjo. Yet, at the same time, the pick-up allows the user to manipulate, through electromagnetic amplification, the sound retrieved by the pick-up. Additionally, a preamplifier may be used in connection with the pick-up.

35 Claims, 7 Drawing Sheets

BANJO PICK-UP SYSTEM

RELATED APPLICATIONS

The present application claims the benefit of U.S. Provisional Patent Application No. 60/431,442, filed Dec. 6, 2002.

BACKGROUND OF THE INVENTION

1. Field of the Invention

The present invention relates to a pick-up system for a Banjo. More specifically, the present invention relates to a pick-up system which can be used with a Banjo without unnecessarily distorting the innate sound.

2. State of the Art

There are numerous instruments which are used in creating types of music. One instrument which has characteristics of certain types of music is a Banjo. While Banjos traditionally have five strings, four string and six string Banjos are also currently available.

While Banjos provide a unique sound, they have one major drawback which limits their usefulness. In many types of music such as rock, jazz, or blues it is difficult for a Banjo to be heard sufficiently so that it is not drowned out by other instruments in the band. This is especially true if the band utilizes a Banjo in conjunction with an electric guitar or other fairly loud instruments, such as drums and/or an electric bass.

Several attempts have been made to provide a system to amplify the sounds of a Banjo. In one attempt, a small microphone is placed adjacent to the body of a Banjo to pick up sounds thereon. This technique can, at times, create feedback and pick up unwanted sounds from other instruments.

In another presently available system, a metal shim is disposed below the Banjo's bridge. A magnetic transducer is then disposed inside of the Banjo's head. Rather than magnifying the sounds of the strings, however, the magnetic transducer merely responds to movement of the metallic shim which moves in connection with the bridge of the instrument.

Still another attempt has been to place a piezoelectric transducer on the Banjo head to generate electric signals in response to vibration. Such a configuration is disadvantageous, however, because it tends to muffle the sound of the Banjo, as well as encourage unwanted feedback.

Thus, there is a need for an improved method for amplifying the sounds of a Banjo while minimizing distortion thereof.

SUMMARY OF THE INVENTION

It is an object of the present invention to provide a pick-up system which amplifies a Banjo sound while minimizing distortion, feedback, or pick-up of sounds from other instruments.

The above and other objects and principles of the invention are accomplished by a Banjo pick-up system having at least one pick-up member. The pick-up member may extend through the Banjo head or may be placed below the surface of the banjo head and not extend through the head.

In accordance with one aspect of the invention, one or more holes are formed in a Banjo head with a pick-up system extending into the hole so as to pick-up the vibrations of the Banjo strings.

In accordance with another aspect of the invention, the one or more holes in the Banjo head are reinforced to prevent ripping or tearing of the Banjo head from the location of the holes.

In accordance with another aspect of the invention, the pick-up includes a plurality of steel pieces which extend through the holes in the head without contacting the head to thereby minimize distortion caused by the pick-up. Thus, the plurality of steel pieces leave the head to float and vibrate freely without interfering with the sound of the banjo.

In accordance with another aspect of the invention, the banjo head is provided with a plug to connect the pick-up system with a conventional amplifying and/or pedal system of an electric guitar thereby enabling both amplification and selective manipulation of the sound of the Banjo. Additionally, the plug may be mounted so as to extend through a hole in the head without contacting the head, leaving the head of the banjo to vibrate freely.

In accordance with another aspect of the invention, the banjo may be provided with a preamplifier. The preamplifier may be equipped with volume, tone, or balance controls, and may be equipped to mix the signals produced by multiple pick-ups which may be mounted to the banjo. A preamplifier would also typically include a plug which allows the banjo to then be connected to a conventional amplifying and/or pedal system, allowing amplification and selective manipulation of the sound.

In accordance with another aspect of the invention, the various plugs and/or control knobs and indicators of the preamplifier may be mounted so as to not interfere with the free movement and vibration of the head of the banjo, and thus not interfere with the sound of the banjo. This may be accomplished by creating holes in the head of the banjo, which may be reinforced, and having the various plugs and controls extend through the holes without contacting the head of the banjo. This may also by accomplished by mounting the plugs and controls of the preamplifier in a manner that they do not contact or extend through the head of the banjo.

In accordance with another aspect of the invention, the preamplifier may be mounted in a box, sometimes referred to as a "break out box." The box may be curved to fit the circular shape of the banjo. This allows the box to be mounted more securely and compactly to the banjo, and also improves the appearance of the box.

The box may be sized to fit inside the head of the banjo and may be attached to the inside of the banjo by adhesive tape or glue, Velcro, bolts, or any other convenient attachment means. The box may be attached to the curved side of the body of the banjo, the back of the body, or the tension bars of the banjo.

The box may also be attached to the outside of the banjo. It would commonly be attached to the curved side wall of the body of the banjo, either on the rearward side or bottom side of the side wall. The box may be designed to use metal clips which hold the box to the side wall of the banjo body. These clips may be biased with elastic material, a spring, or the like to hold the box securely to the banjo. Additionally, the box may be configured to use an elastic or Velcro strap to hold the box to the banjo. Many attachment means are available and equally suitable to hold the preamplifier box to the side of the banjo.

BRIEF DESCRIPTION OF THE DRAWINGS

The above and other objects, features and advantages of the present invention will become apparent from a consideration of the following detailed description in which.

DETAILED DESCRIPTION

Reference will now be made to the drawings in which the various elements of the present invention are discussed in a manner to enable one of skill in the art to make and use the invention. It is to be understood that the following description is only exemplary of the principles of the present invention and should not be viewed as limiting the appended claims.

Figure 1:
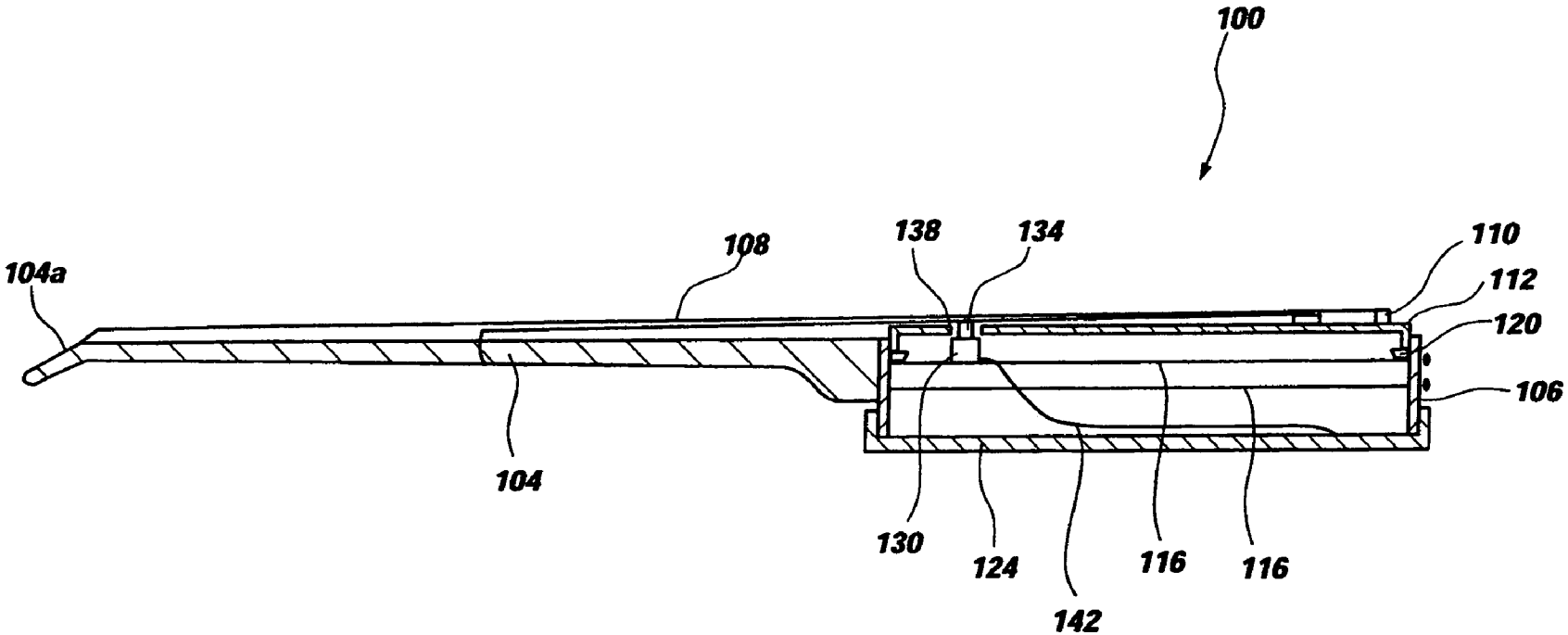
FIG. 1 shows a cross-sectional view of a Banjo having a pick-up system made in accordance with the principles of the present invention.

Referring to FIG. 1, there is shown a cross-sectional view of a banjo, generally indicated at 100. The banjo 100 includes a neck 104 and a plurality of strings 108 most of which extend from a distal end 104*a* of the neck across the banjo head 112 to an attachment 110, which is attached to a banjo tone ring 120. The banjo head is mounted on a tone ring 120 and stabilizer bars 116 which hold the neck 104 in place. A resonator 124 is positioned below the stabilizer bars 116 to directionalize the sound of the banjo.

In a conventional Banjo, plucking a string 108 causes the string to vibrate. Vibration of the string 108 causes a vibration of the head 112 and the sound produced bounces off the resonator 124 to produce the well known sound of a Banjo. However, as indicated in the background section, it is difficult to get the resonator 124 to provide sufficient amplification of the sound so that the Banjo is not drowned out by other amplified instruments.

In accordance with the present invention, it has been found that a pick-up 130 can be disposed beneath the head 112 with a plurality of pick-up tubes 134 extending one or more holes 138 in the head 112 so as to be adjacent to the strings 108 of the Banjo. As a string 108 of the Banjo is plucked, the vibration is sensed by a metallic head in the pick-up 130 to generate a signal. The signal passes through one or more coils disposed adjacent a magnet. The resulting signal is conveyed by a lead wire 142, which carries the signal to the exterior of the banjo 100, where it is further conveyed to an amplifier, not shown.

In accordance with the present invention, it has been found that having the pick-up system 130 extend through the head 112 of the banjo 100 creates very little distortion of the innate sound of the banjo. At the same time, the pick-up system 130 enables the sound to be amplified through, for example, a conventional amplification system for electric guitars, to thereby enable the banjo to compete in volume with other instruments, from the jazz, blues, rock and country genres.

Because of the hole(s) 138 formed in the head 112 of the banjo, a pick-up system 130 can be used which is adjustable. In such a system, the pick-up tubes 134 typically have an adjustable 200 metallic head (FIG. 3) which can be raised or lowered to change the distance from the electromagnetic force of the pick-up head 200 to the string 108. Thus, the user of the banjo 200 is able to customize the amplification provided by the pick-up system perstring to provide the desired amplification for the type of music and style of the user.

Figure 2:
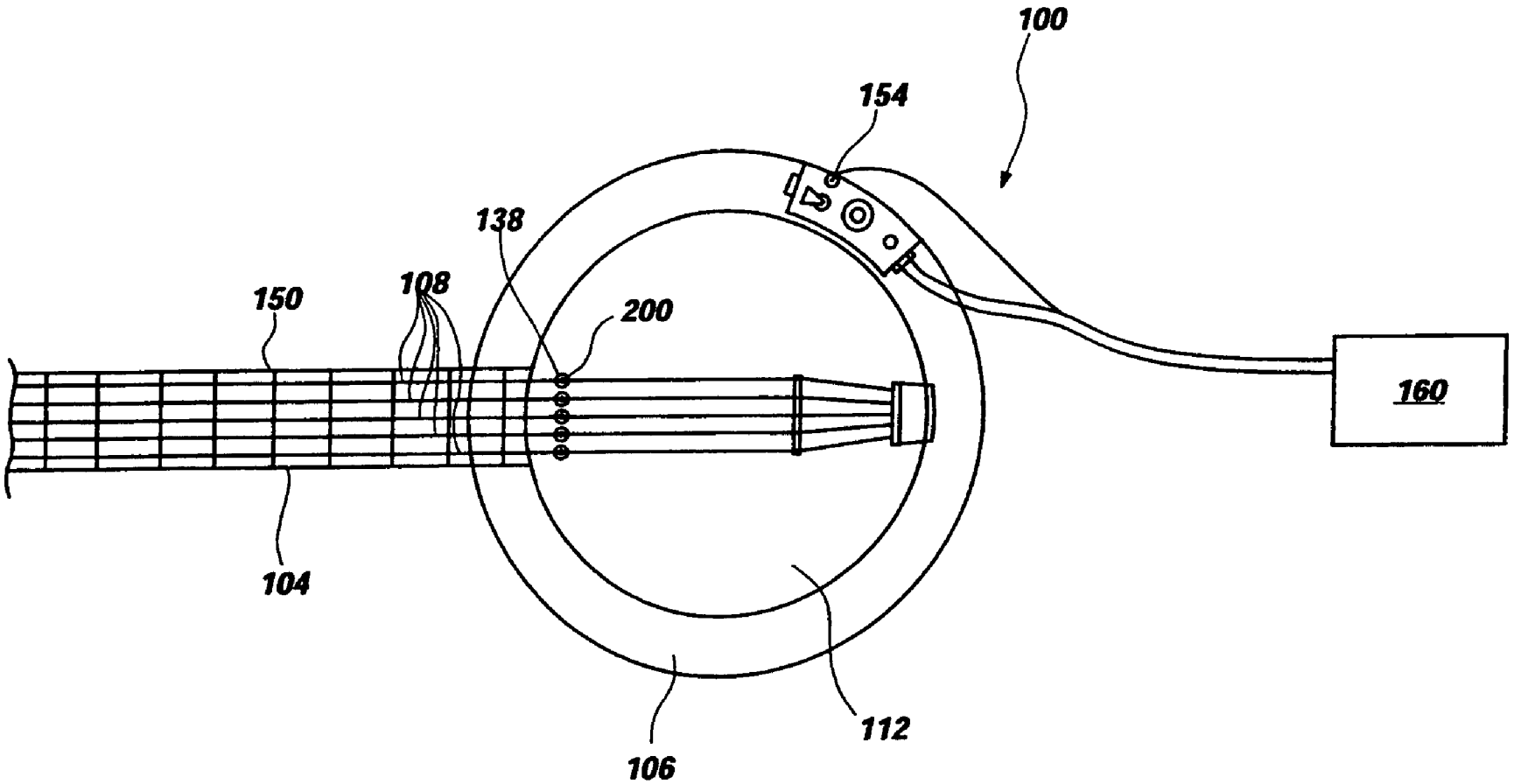
FIG. 2 shows a fragmented top view of the banjo of FIG. 1.

Turning now to FIG. 2, there is shown a fragmented, top view of the banjo 100. The banjo includes the neck 104 which is attached to the body 106 and held in place by the bars 116 (not shown in FIG. 2). The neck 104 has a plurality of frets 150 to demarcate distance along the neck. As the strings 108 pass beyond the neck and over the head 112, they pass over the five holes 138. While banjos typically have five strings, banjos are available with different numbers of strings.

Visible in the holes 138 are the metallic heads 200 which are positioned beneath the strings 108. As the strings 108 vibrate, the metallic, heads 200 generate signals which are then amplified by the pick-up 130, of which only the metallic heads 200 are shown in FIG. 2. The signal generated is then carried by the lead wire 142 to a plug 154 on the body 106 of the banjo 100, which is connected to an amplification system, represented by box 160.

With the banjo 100 so arranged, the user is able to play the banjo and be heard among other instruments. Additionally, attaching the banjo 100 to the amplification system 160 enables the user to selectively manipulate sounds with a foot pedal, etc., as is commonly done with electric guitars. Thus, the user is provided with significantly improved control of what the audience hears from the banjo 100.

Figure 3:
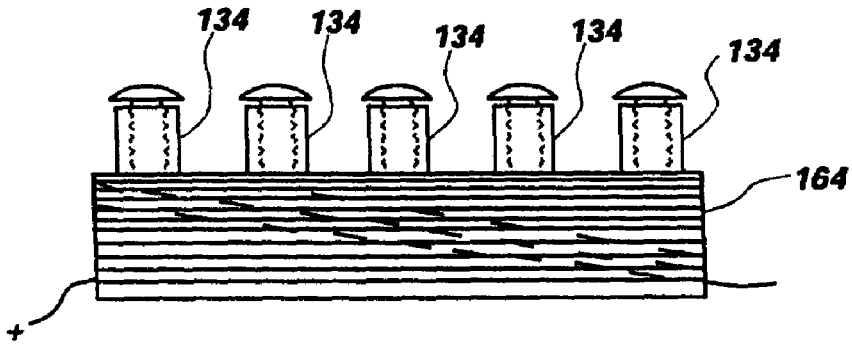
FIG. 3 (PRIOR ART)
FIG. 3 shows a prior art pick-up as may be used in accordance with the principles of the present invention.

Turning now to FIG. 3, there is shown a close-up view of the pick-up system 130. The pick-up system 130 includes a plurality of metallic tubes 134 (typically steel) which extend upwardly from a wire wrapped base 164. The base 164 can be wrapped unidirectionally, or can be bidirectionally wrapped to form what is called a humbucker. Typically the negative lead would form the lead wire 142. The humbucker can also be switched to a unidirectional pick-up if desired.

Figure 4:
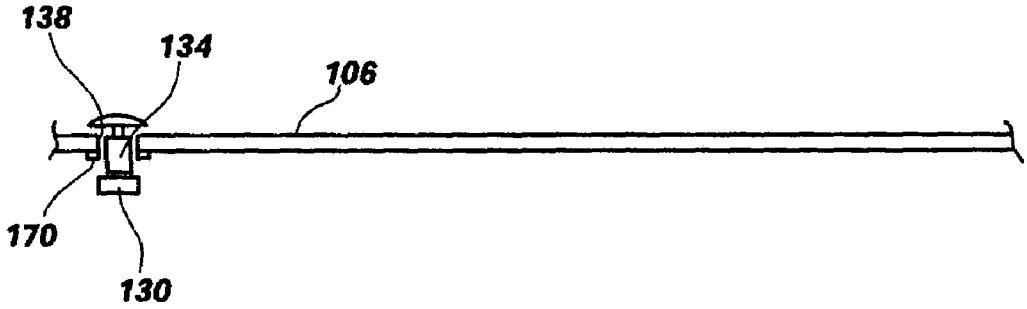
FIG. 4 shows a close up, cross-sectional view of another embodiment of the present invention.

FIG. 4 shows a cross-sectional view of the banjo head 112 with a hole 138 through which the tube 134 has been positioned. The hole 138 is a single hole for receiving all of the pick-up heads, as opposed to a plurality of holes shown in FIG. 2. A support surface 170 is disposed about the hole to provide additional support. The support surface 170 can be formed from similar material to the banjo's head 112, or can include any type of reinforcement material such as glue, stiffener or a coating. The reinforcement is primarily to prevent the hole from being enlarged and damaging the remainder of the head.

Figure 5:
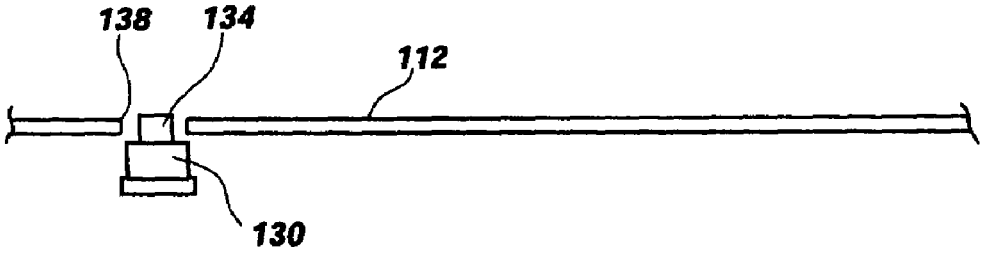
FIG. 5 shows a close-up view of yet another embodiment of the present invention.

Those skilled in the art will appreciate that adjustable pick-up heads and non-adjustable pick-up heads can be used. Thus, for example, FIG. 5 shows a non-adjustable pick-up head.

The hole(s) 138 in the head 112 of the banjo can be formed in a number of ways. For example, if the banjo's head is made of plastic, the holes can be formed in the molding process. In the alternative, the holes can be cut or seared into the head. A variety of different cutting or searing mechanisms can be used.

Once the hole(s) 138 are formed in the banjo head 112, the pick-up system 130 is mounted in the banjo body 106, preferably with the pick-up system resting on the stabilizer bars 116 (FIG. 1). Ideally the metallic heads 200 of the pick-up system extend through the hole(s) 138. It should be appreciated, however, that the metallic heads could be positioned below the holes and the pick-up system itself need not be mounted on the stabilizer bars.

Figure 6:
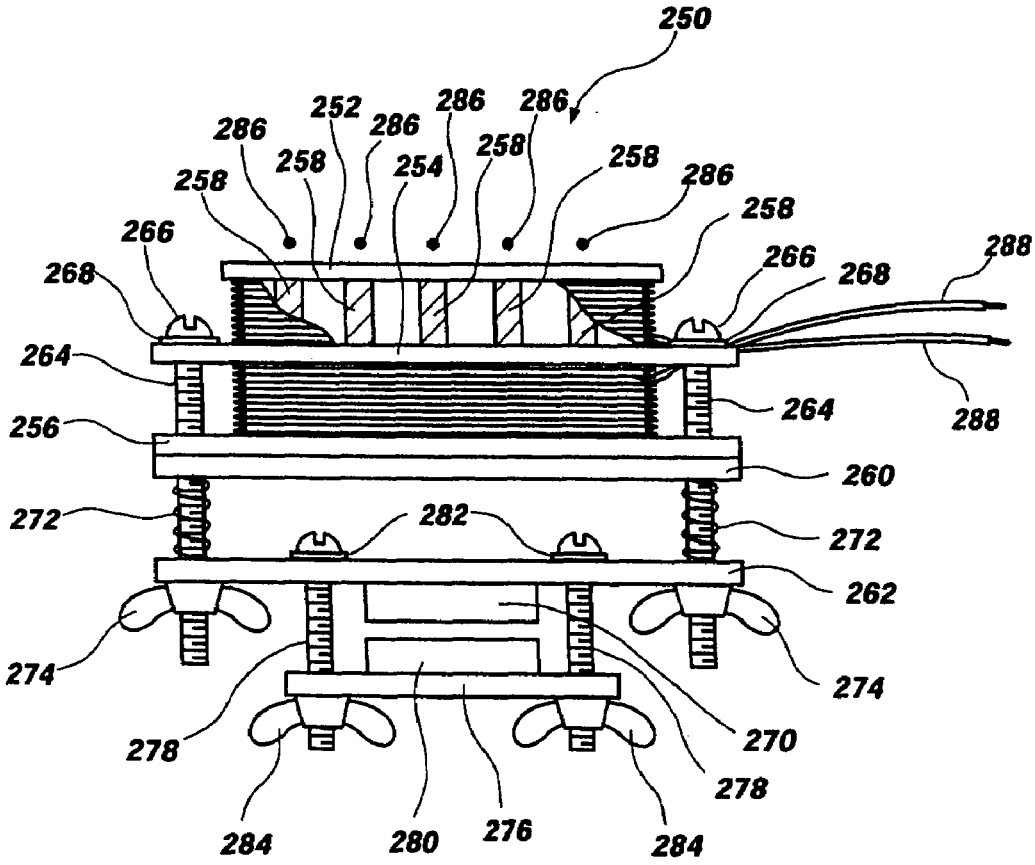
FIG. 6 shows a pick-up according to the principles of the present invention.

Turning now to FIG. 6, another pick-up system is shown, indicated generally at 250. The pick-up system uses a humbucker type pick-up which is known in the prior art. The humbucker pick-up includes a upper plate 252, a middle plate 254, and a lower plate 256, which may be formed of a vulcanized fiberboard or other suitable material. The pickup has been constructed with 5 cylindrical magnets 258, being a 5 pole humbucker pick-up which is optimized for a 5 string banjo. To the humbucker pick-up has been added a copper or copper clad steel base plate 260.

The pick-up is attached to an upper mounting plate 262 by two connecting bolts 264. A washer 268 made of plastic may be used in connection with the bolt heads 266 to protect the pick-up and isolate the bolt head 266 from any electrical connections. The upper mounting plate 262 may be made from metal, plastic, or some other suitable material, and has a mounting pad 270 attached to the mounting plate 262. The mounting pad 270 is typically made of a resilient material such as rubber.

The connecting bolts 264 are used in connection with springs 272 and wing nuts 274, or another readily adjustable nut, so that the height of the pick-up may be adjusted relative to the upper mounting plate 262. The springs 272 should be sufficiently strong to keep the pick-up in a desired position without significant movement.

A lower mounting plate 276 is attached to the upper mounting plate 262 by mounting bolts 278. The lower mounting plate 276 typically has a mounting pad 280 attached in a position opposed to the mounting pad 270 on the upper mounting plate 262. The lower mounting pad 280 is typically made of a resilient material such as rubber. Washers 282 may be used in connection with the mounting bolts 278 if desired. Wing nuts 284 are used on the mounting bolts 278 to easily attach the pick-up system 250 to a banjo tension bar.

Also indicated are the banjo strings 286. Shown are the strings 286 of a 5 string banjo. FIG. 6 indicates the approximate relationship between the strings 286 and the magnets 258. The magnets 258 are spaced in the pick-up 250 such that they are positioned generally below the strings 286.

The pick-up system 250 is attached to lead wires 288 which are connected to a plug or preamplifier (not shown) and carry the signal generated by the pick-up.

Figure 7:
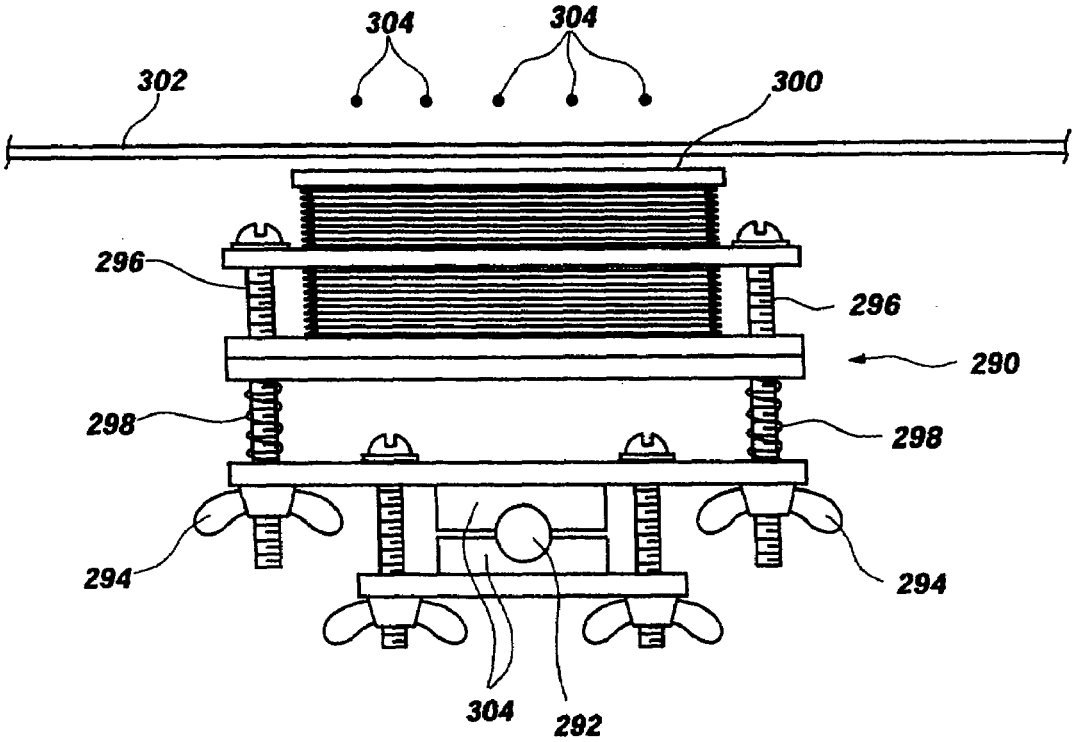
FIG. 7 shows a pick-up according to the present invention as it may be mounted to a banjo.

Turning now to FIG. 7, a pick-up, indicated generally at 290, is shown. The pick-up 290 is attached to the tension bar 292 of a banjo. The wing nuts 294 on the connecting bolts 296 have been adjusted, compressing the springs 298 and bringing the upper surface 300 of the pick-up 290 in close proximity with the head 302 of the banjo. It is desirable to have the upper surface 300 of the pick-up 290 held close to the head 302 so that the pick-up 290 receives a strong signal from the vibrations of the banjo strings 304.

It is important that the upper surface 300 of the pick-up 290 not contact the head 302 of the banjo. Such contact could cause the noise from the head 302, which vibrates while the banjo is played, striking the upper surface 300 of the pick-up 290. It is desirable for the head 302 to vibrate freely to produce better sound from the banjo.

The resilient mounting pads 304 should be sufficiently hard to hold the pickup 290 firmly and also sufficiently soft to allow them to grip the tension bar 292. If the mounting pads 304 are made of rubber, for example, a rubber of sufficient hardness may be selected to hold the pick-up 290 securely in place.

Figure 8:
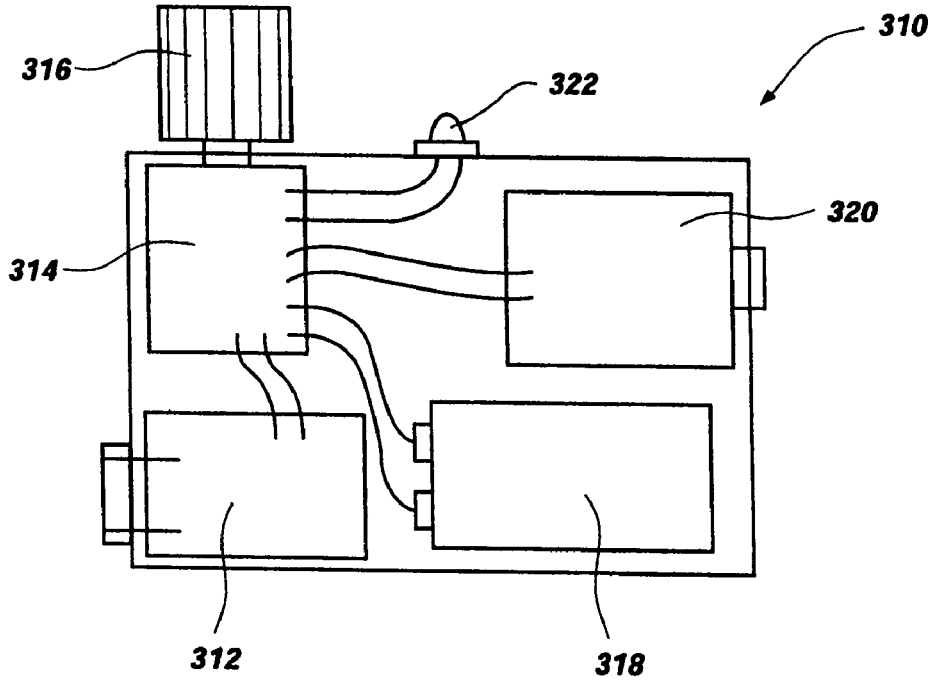
FIG. 8 shows a preamplifier according to principles of the present invention.

Referring now to FIG. 8, an example preamplifier, indicated generally at 310, is shown. The preamplifier 310 would typically contain an input 312 which could be a plug receptacle, or other suitable input. The pick-up is connected to the input 312 of the preamplifier 310. The input 312 is connected to an amplification circuit 314, which may include a volume control 316. A power source, 318, typically a battery, is also connected to the amplification circuit 314. The amplification circuit 314 is also connected to an output 320, which is typically a receptacle for a plug which would carry the amplified signal to an amplifier (not shown). The preamplifier may be equipped with a light emitting diode (LED) 322 to indicate if the preamplifier is working.

The preamplifier circuit 310 thus receives the signal produced by a pick-up and increases the strength of the signal. This is advantageous because it will reduce the amount of noise in the final signal received by an amplifier (not shown) and improve the sound quality of the music produced. If the preamplifier circuit 310 is equipped with a volume control knob 316, it allows the musician to adjust the volume of the instrument while playing without walking back and forth to the amplifier.

Figure 9:
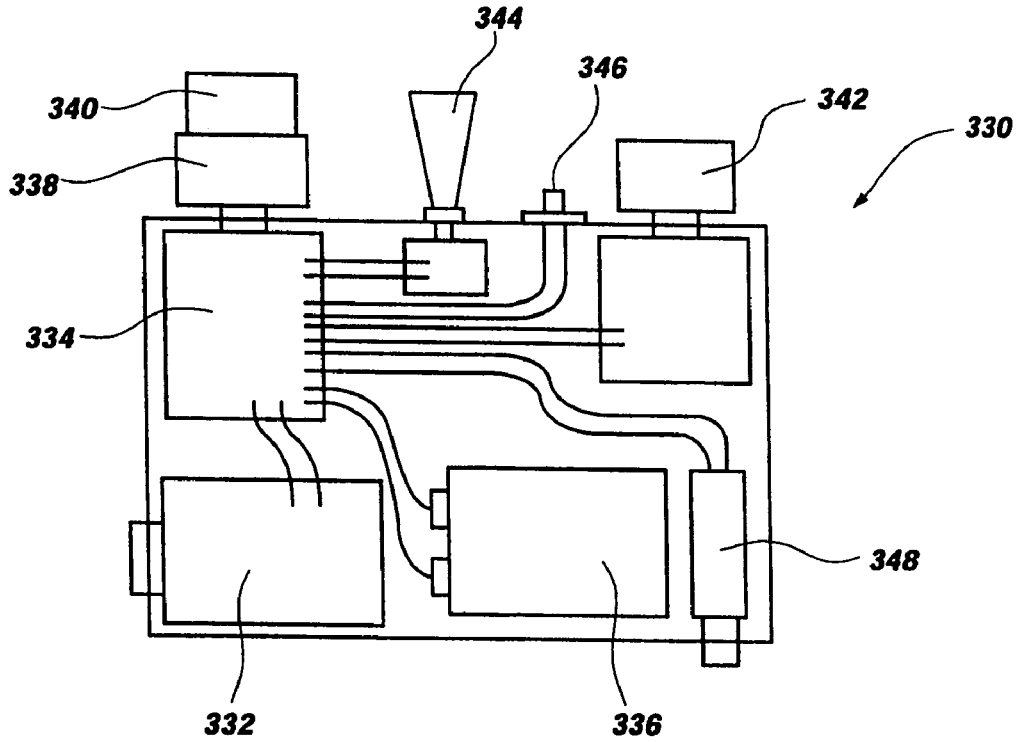
FIG. 9 shows another preamplifier according to the principles of the present invention.

Turning now to FIG. 9, another preamplifier circuit, indicated generally at 330, is shown. The preamplifier 330 includes an input 332, typically a plug receptacle, which receives the signal from the pick-up and transmits it to the amplifier circuit 334. A power source 336, such as a battery, supplies power to the preamplifier 330. The preamplifier circuit 334 shown includes a volume control 338 and a tone control 340. The tone control allows the musician to adjust the tonal characteristics of the sound produced.

The preamplifier 330 may also include a mixing knob 342 which allows the musician to blend the signals received from two pick-ups which may be mounted in different locations on the banjo. Mixing the two signals allows the musician to adjust the relative strength of each signal. If two pick-ups are used, the input 332 would be configured to accept two pick-up inputs, which would be mixed by the mixing knob 342 before being fed into the amplifier circuit 334.

The preamplifier 330 may also be equipped with a switch 344 which allows the musician to selectively turn the preamplifier 330 on or off. Additionally, a LED 346 may be included to indicate to the musician whether the preamplifier is switched on or off. An output 348, typically a plug receptacle, allows a cable to plug into the preamplifier and carry the amplified signal to the amplifier used (not shown).

The preamplifier 330 is advantageous because the sound of the instrument may be controlled at the instrument itself by adjusting the volume, tone, balance, or other included controls. Thus, the musician does not need to walk back and forth to the amplifier during the performance to adjust the sound of the banjo. Additionally, the signal generated by the pick-up mounted to the instrument may be a relatively weak signal, and the preamplifier will increase the strength of the signal before the signal is sent to the amplifier, reducing the effect of noise generated either in the wires between the instrument and the amplifier or the amplifier itself.

Figure 10:
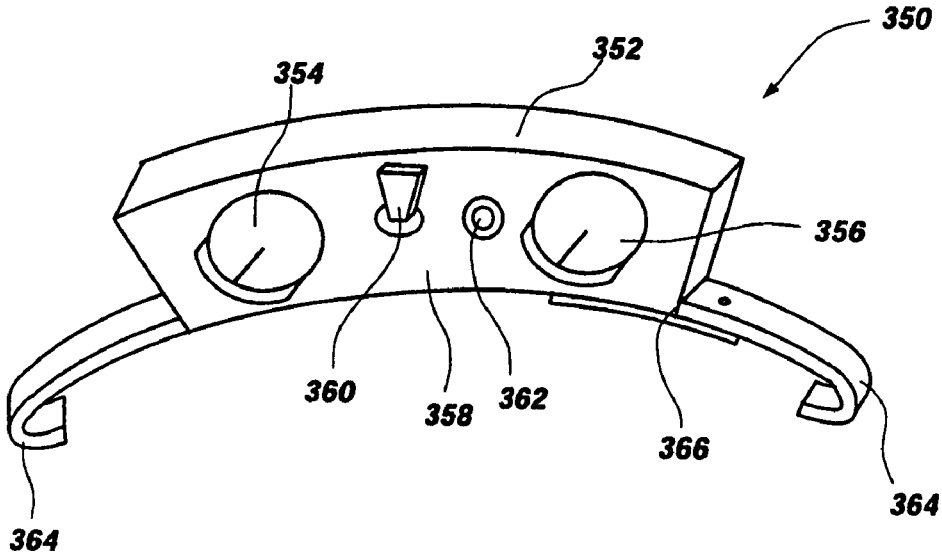
FIG. 10 shows a perspective view of a preamplifier in accordance with the present invention.

Turning now to FIG. 10, a preamplifier, indicated generally at 350, is shown. The case 352 of the preamplifier 350 may be designed in a curved configuration as shown. This curved configuration would allow the preamplifier 350 to be mounted securely and attractively to either the inside or outside of the body of a banjo. The various controls of the preamplifier 350, such as the volume 354 or tone 356, are mounted to the upper surface 358 of the preamplifier 350. The upper surface 358 is typically flat, although it may be curved if desired. A switch 360 and LED 362 may also be mounted to the preamplifier 350.

Also shown are two attachment brackets 364 which may be used to hold the preamplifier 350 to the banjo. The brackets 364 may be rigidly attached to the preamplifier 350, or may be attached to a resilient member 366, which is attached to the preamplifier 350. The resilient member stretches and allows the bracket 364 to be positioned on the banjo while holding the preamplifier 350 tightly to the banjo. Many additional attachment means other than mounting brackets 364 may be used to attach the preamplifier 350 to the banjo. For example, a strap with Velcro and/or elastic, adhesive tape, or adhesive glue could all be used to securely attach the preamplifier 350 to a banjo.

Figure 11:
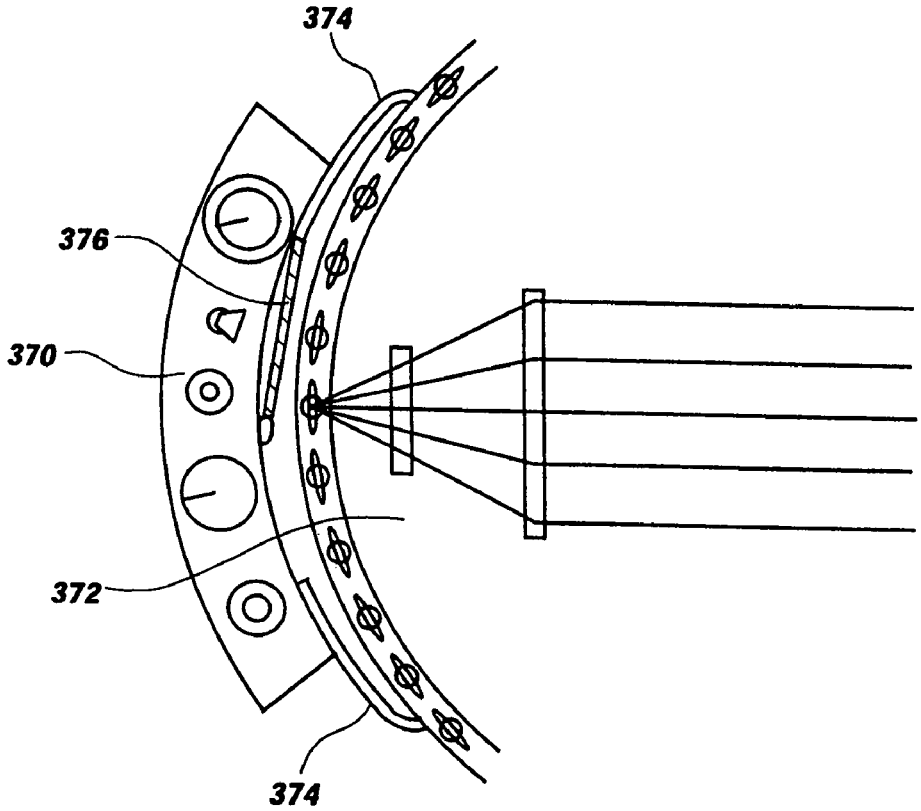
FIG. 11 shows a preamplifier box mounted to a banjo according to the present invention.

Turning now to FIG. 11, a preamplifier 370 is shown attached to the side of a banjo body 372. Attachment brackets 374 are used to secure the preamplifier 370 to the banjo 372, and a resilient elastic member 276 is used bias the brackets 374 against the banjo 372, holding the preamplifier 370 securely in place.

Thus there is disclosed an improved banjo pick-up system which is believed to be an improvement over the prior art. Those skilled in the art will appreciate numerous modifications which can be made to the pick-up system without departing from the scope or spirit thereof. The appended claims are intended to cover such modifications.

What is claimed is:

1. A banjo having a pick-up system comprising:

a banjo having a banjo head, and a pick-up system, the pick up system comprising a plurality of pick-up heads extending therefrom;

a plurality of holes formed in the banjo head; and wherein the pick-up system is mounted such that each of the plurality of pick-up heads extends through one of the plurality of holes such that the pick-up heads do not touch the banjo head.

2. The banjo according to claim 1, wherein each pick-up head comprises a button disposed on the top thereof, and wherein the button is of larger diameter than the hole in the banjo head through which the pick-up head extends so as to cover the holes in the banjo head.

3. The banjo according to claim 2, wherein the pick-up is mounted so as not to touch the banjo head.

4. The banjo according to claim 2, further comprising a reinforcement layer disposed about the plurality of holes.

5. The banjo according to claim 1, wherein the banjo comprises stabilizer bars, and wherein the pick-up system is mounted on the stabilizer bars.

6. The banjo according to claim 1, wherein the banjo head is mounted on a body, and further comprising a lead wire extending from the pick-up system to the exterior of the banjo body.

7. The banjo according to claim 1, wherein the pick-up system comprises adjustable pick-up heads.

8. The banjo of claim 1, further comprising a preamplifier.

9. The banjo of claim 1, further comprising a second pick-up system.

10. A method for forming a banjo with a pick-up system, the method comprising:

selecting a banjo having a banjo head mounted on a body;

forming at least one hole in the banjo head;

disposing a pick-up system in the banjo body so as to not touch the banjo head;

wherein the pick-up system has five metallic pick-up heads, and wherein the method comprises forming five holes in the banjo head; and wherein the method further comprises positioning the metallic pick-up heads of the pick-up system such that each of the metallic pick-up heads extends through one of the holes in the banjo head.

11. The method according to claim 10, wherein the method comprises disposing a pick-up system with at least one pick-up head so that the at least one pick-up head of the pick-up system extends into the at least one hole in the banjo head.

12. The method according to claim 10, wherein the method comprises reinforcing the banjo head about the at least one hole.

13. The method according to claim 10, wherein the banjo body has at least one stabilizer bar and wherein the method further comprises mounting the pick-up system on the at least one stabilizer bar.

14. The method according to claim 10, wherein the method further comprises placing a button on top of each pick-up head, the button having a greater diameter than the holes through which the pick-up heads extend so as to cover the holes.

15. The method according to claim 10, wherein the method comprises using a humbucking electromagnetic pick-up.

16. The method according to claim 15, wherein the humbucking electromagnetic pick-up comprises a unidirectional single coil electromagnetic pick-up.

17. A banjo pick-up system comprising:

a banjo having a banjo head, the banjo head having a plurality of holes formed therein for receiving the individual heads of a pick-up;

a pick-up comprising a plurality of pick-up heads;

a mounting plate configured to attach to the tension bar of a banjo; and an adjustment mechanism configured to allow adjustment of the position of the pick-up relative to the banjo head so as to extend the pick-up heads through the plurality of holes formed in the banjo head without the pick-up touching the banjo head; and a plurality of buttons, one button mounted on the top of each pick-up heads, the buttons being of sufficient diameter to cover the holes formed in the banjo head.

18. The system of claim 17, wherein the pick-up comprises a humbucker type pick-up.

19. The system of claim 17, wherein the adjustment mechanism comprises at least one bolt and at least one nut and wherein rotation of the at least one nut or the at least one bolt moves the pick-up relative to the mounting plate.

20. The system of claim 19, further comprising at least one spring to inhibit movement of the pick-up relative to the mounting plate.

21. The system of claim 17, wherein the mounting plate further comprises a clamping plate and wherein the tension bar is positioned between the mounting plate and the clamping plate.

22. The system of claim 21, further comprising at least one bolt to bias the clamping plate towards the mounting plate.

23. The system of claim 21, further comprising at least one resilient pad attached to the mounting plate or the clamping plate.

24. The system of claim 17, further comprising a preamplifier configured to adjust at least one of the group consisting of the volume, the tone, and the balance of the pick-up.

25. The system of claim 17, wherein the pick-up is mounted inside of the banjo.

26. The system of claim 17, further comprising a second pick-up.

27. The system of claim 26, wherein the preamplifier allows for independent adjustment of at least one of the group consisting of the volume, balance, and tone of the pick-ups.

28. The banjo pick-up system of claim 17, further comprising a banjo preamplifier comprising:

a signal amplification circuit;

a volume control; and a box for holding at least one of the signal amplification circuit and the volume control, the box being curved to fit the curve of the banjo body.

29. The banjo pick-up system of claim 28, wherein the preamplifier is mounted to the banjo.

30. The banjo pick-up system of claim 28, further comprising tone control.

31. The banjo pick-up system of claim 28, wherein the preamplifier is configured to accept the signal from multiple pick-ups.

32. The banjo pick-up system of claim 31, wherein the preamplifier allows adjustment of the signal strength of the individual pick-ups, relative to the other pick-ups.

33. The banjo pick-up system of claim 31, wherein the preamplifier allows adjustment of the tone of the individual pick-ups, relative to the other pick-ups.

34. The banjo pick-up system of claim 28, wherein the preamplifier further comprises clips configured to attach to the banjo.

35. The banjo pick-up system of claim 28, wherein the preamplifier further comprises a resilient member to attach the preamplifier to the banjo.

* * * * *